United States Patent [19]

Steinberg et al.

[11] Patent Number: 5,039,396

[45] Date of Patent: Aug. 13, 1991

[54] HYDROTREATER FEED/EFFLUENT HEAT EXCHANGE

[75] Inventors: Robert M. Steinberg; Vijay A. Deshpande, both of Houston, Tex.

[73] Assignee: Texaco Inc., White Plains, N.Y.

[21] Appl. No.: 559,248

[22] Filed: Jul. 30, 1990

[51] Int. Cl.[5] ..... C10G 45/00

[52] U.S. Cl. ..... 208/143; 208/80; 208/81; 208/82; 208/48 Q; 208/251 H; 208/254 H; 208/264; 208/353; 208/365

[58] Field of Search ..... 208/218, 80, 81, 82, 208/353, 365, 264, 251 H, 254 H, 143, 221, 48 Q

[56] References Cited

U.S. PATENT DOCUMENTS

| | | | |
|---|---|---|---|
| 2,294,126 | 8/1942 | Ocon | 208/82 |
| 3,429,801 | 2/1969 | Gleim et al. | 208/264 |
| 3,673,078 | 6/1972 | Kirk, Jr. | 208/264 |
| 3,804,748 | 4/1974 | Nelson et al. | 208/218 |
| 3,919,074 | 11/1975 | Gatsis | 208/82 |
| 4,931,165 | 6/1990 | Kalnes | 208/143 |

*Primary Examiner*—Helane E. Myers

*Attorney, Agent, or Firm*—Jack H. Park; Kenneth R. Priem; Richard A. Morgan

[57] ABSTRACT

A heat integrated hydrotreating process has been invented. The feedstock is a cracked hydrocarbon stock which is mixed with hydrogen to suppress coking before heating in a multiple tube furnace to reactor inlet temperature. A minor portion of the feedstock is mixed with hydrogen and heated to reactor inlet temperature by quenching the hot reactor effluent. The minor portion is fed directly to the hydrogenation reactor, bypassing the furnace. By the process, high level heat is recovered.

4 Claims, 2 Drawing Sheets

HYDROTREATER FEED/EFFLUENT HEAT EXCHANGE

BACKGROUND OF THE INVENTION

1. Field of the Invention

The invention relates to heat integration of a catalytic hydrogenation process. More particularly the invention relates to preheating a portion of feedstock by indirect heat exchange with hot reactor effluent. Most particularly the invention relates to quenching the entire hot reactor effluent with a predetermined amount of feedstock.

2. Description of Other Related Methods in the Field

Hydrotreaters are employed in petroleum refineries to hydrogenate petroleum derived stocks. Hydrogenation removes sulfur, nitrogen, metals and other undesirable contaminants from the stock. Hydrogeneration also saturates olefinic and aromatic compounds rendering the stock more stable to thermal degradation as well as stabilizing color.

Hydrotreating is typically carried out in a packed bed of catalyst. Hydrotreating catalysts typically comprise a Group IV metal or a Group VI metal on a porous solid support. The most typical metals are nickel, Raney nickel, cobalt and molybdenum. Cobalt-molybdenum and nickel-molybdenum on an aluminum support are in wide commercial use in the industry for this purpose. The hydrogeneration reaction is carried out at a hydrogen partial pressure of 100 to 2000 psia and a temperature of 400° F. to 800° F.

A hydrotreater typically comprises a charge pump, a make-up hydrogen compressor, feed/effluent and hydrogen/effluent heat exchangers, a charge heater, one or more reactors, product separators, a recycle hydrogen compressor and product fractionators.

The feed/effluent and hydrogen/effluent exchangers are used to preheat the reactants. The charge heater supplies the remaining heat to bring the feed to reactor inlet temperature. The reactor effluent is cooled several hundred degrees before reaching the product separators. Heat is recovered by heat exchange with the reactants. Hydrogen and oil may be mixed either upstream or downstream of the feed/effluent exchangers. Mixing upstream of the exchangers provides greater temperature differentials, higher heat transfer coefficients and reduced fouling. This is typical of a feed which is fully vaporized in the exchangers. However, when a mixed phase is fed to the reactors and/or charge heaters this can be a problem except for small units with a single pass heater (less than 5000 barrels per day). In all but the small units the mixed hydrogen and oil must be fed to a multi-pass heater. To avoid maldistribution in the multiple passes there must be a flow control valve on each pass. Since two-phase mixtures are hard to measure and control the hydrogen and oil must be passed through separate heat exchangers trains.

SUMMARY OF THE INVENTION

The invention is a hydrotreating process for catalytically hydrogenating a hydrocarbon stock, typically a cracked hydrocarbon stock. The hydrocarbon stock is divided into two portions; a major portion and a minor portion.

The major portion is mixed with hydrogen to form a two-phase major portion mixture and passed through a multiple pass tube furnace to heat the mixture to a reactor inlet temperature of preferably 600° F. to 700° F. In the reactor the combined major and minor portions are catalytically hydrogenated and the temperature increased by heat of reaction to a reactor outlet temperature, typically 630° F. to 750° F. The entire reactor effluent is withdrawn at this temperature.

The minor portion is mixed with hydrogen and heated by indifect heat exchange with the reactor effluent to the reactor inlet temperature and in the absence of additional heating, passed to the reactor. The amount of minor portion is chosen to quench the entire reactor effluent from the reactor outlet temperature to the reactor inlet temperature.

DETAILED DESCRIPTION OF THE DRAWINGS

Figure 1:
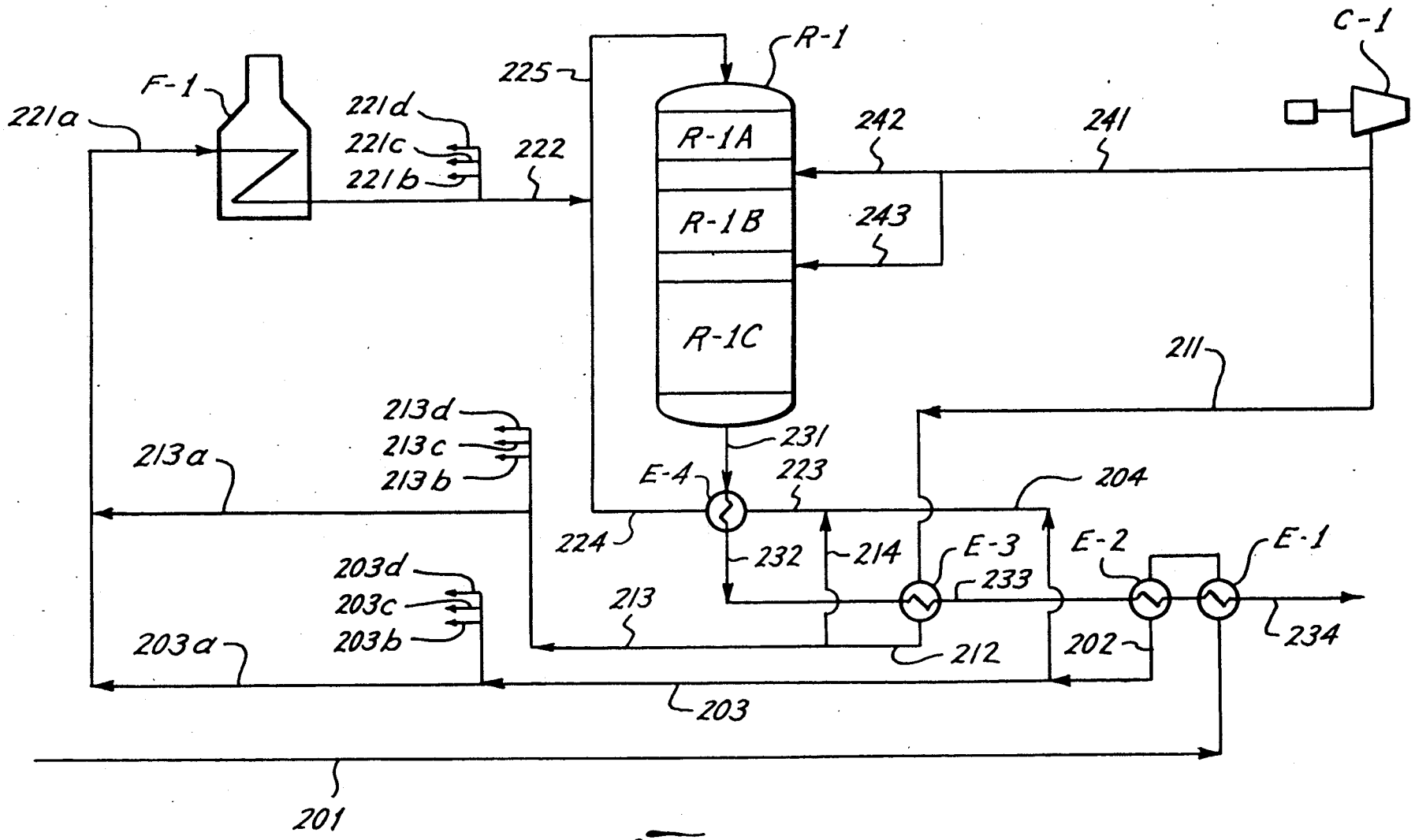
FIG. 1 is a simplified process flow diagram of a hydrotreating process with one reactor vessel.

Reference is made to FIG. 1. A cracked hydrocarbon feedstock such as a coker distillate fraction of fluid catalytic cracking is passed via line 201 under flow control where it is preheated on the shell side of heat exchangers E-1 and E-2 and exits via line 202. The feedstock is divided into major portion in line 203 and a minor portion in line 204. This division is achieved by flow control. The major portion is then subdivided in lines 203*a*, 203*b*, 203*c* and 203*d*, each of which is connected to a separate tube passing through multiple pass furnace F-1. An equal flow rate through each line is maintained by flow control.

Hydrogen is passed via line 211 into the unit where it is preheated on the shell side of heat exchanger E-3 and exits via line 212.

Hydrogen flow is divided in proportion to the division made of the feedstock into a major hydrogen portion in line 213 and a minor hydrogen portion in line 214. Major hydrogen portion in line 213 is subdivided in lines 213*a*, 213*b*, 213*c* and 213*d* with equal flow passing through each line on flow control.

Hydrogen in line 213*a* is mixed with feedstock in line 203*a* to form a two-phase mixture. The mixture is passed through tube 221*a* in multiple pass tube furnace F-1. Line 203*a*, line 213*a* and tube 221*a* are representative of hydrogen in lines 213*b*, 213*c* and 213*d* being mixed with feedstock in lines 203*b*, 203*c* and 203*d* and passed through tubes 221*b*, 221*c* and 221*d*.

In multiple pass tube furnace F-1 the temperature of the feedstock/hydrogen mixture is raised to a reactor inlet temperature of about 690° F. The multiple passes through furnace F-1 are recombined in line 222 and passed via line 225 to reactor R-1 containing three fixed beds (R-1A, R-1B and R-1C) of cobalt-molybdenum hydrogeneration catalyst. Reactor pressure is 700 to 800 psig. At these conditions the distillate fraction is hydrogenated.

Interbed cooling is provided with a hydrogen quench via line 241. Quench is provided between beds R-1A and R-1B via line 242 and between beds R-1B and R-1C via line 243 each on temperature control cascading to flow control. Heat of reaction produces a temperature increase of 40° across the reactor R-1. Hydrogenated distillate stock leaves reactor R-1 via line 231 at a temperature of 730° F. into the tube side of heat exchanger E-4.

The hydrogen minor portion in line 214 is mixed with the minor portion of feedstock in line 204 and flowed in a two-phase mixture via line 223 through the shell side of heat exchanger E-4. The minor portion is in an amount to quench the hydrogenated distillate stock from 730° F. to 690° F. Hydrogenated distillate stock flows through the tube side of heat exchangers E-3, E-2 and E-1 where the temperature is reduced by heat exchange with hydrogen in heat exchanges E-3 and feedstock in heat exchangers E-2 and E-1.

Feedstock minor portion is heated on the shell side of heat exchanger E-4 to a temperature of approximately 690° F. in line 224. Minor portion in line 224 is combined with major portion in line 225, both at approximately the same temperature and passed together to reactor R-1 for hydrogenation.

Figure 2:
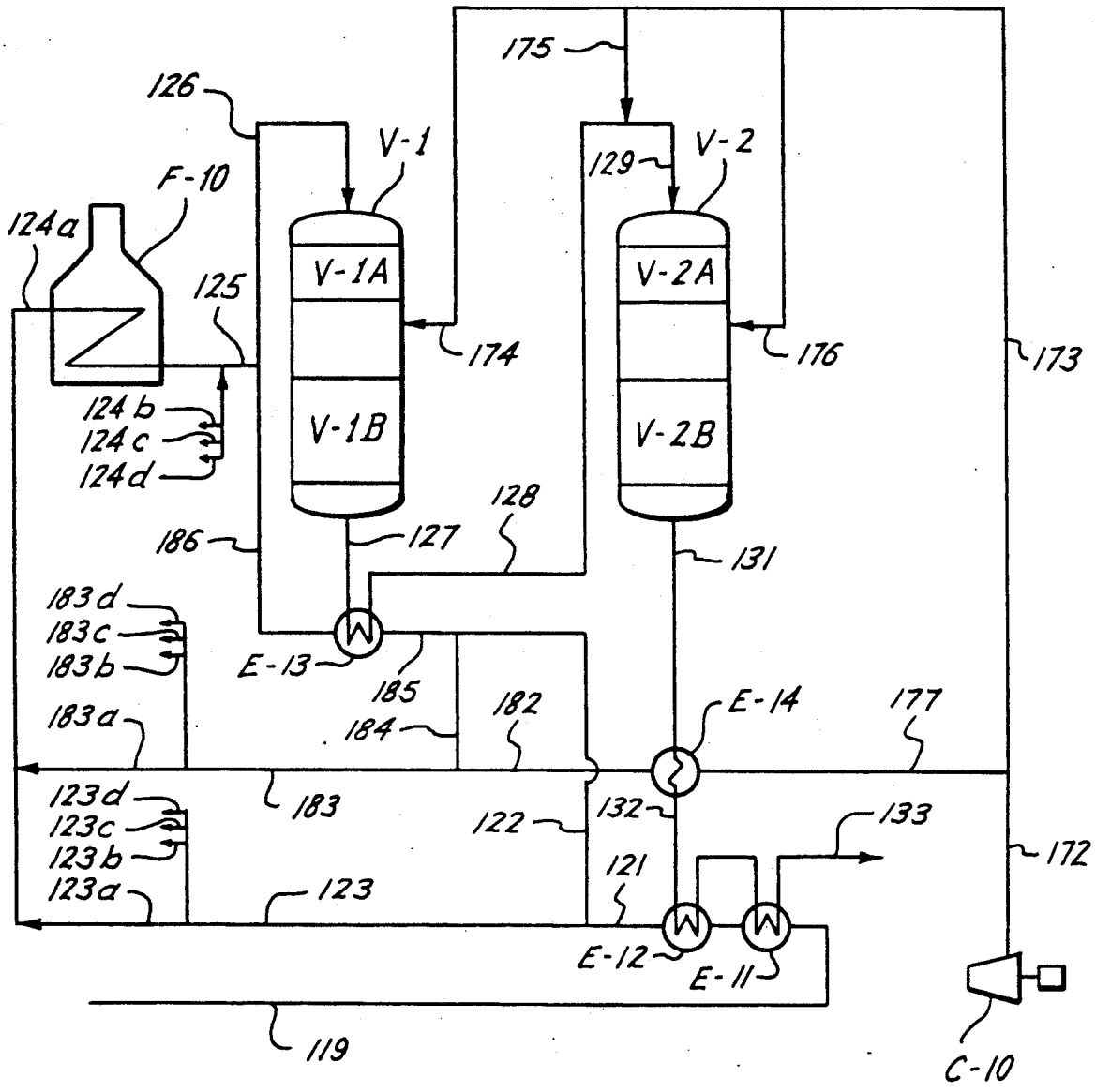
FIG. 2 is a simplified process flow diagram of a hydrotreating process with two reactor vessels.

Reference is made to FIG. 2. A cracked hydrocarbon feedstock such as an intermediate cycle oil from a fluid catalytic cracker is passed via line 119 under flow control. The feedstock is preheated in heat exchangers E-11 and E-12.

The feedstock is divided by flow control into a major portion in line 123 and a minor portion in line 122. The major portion is subdivided in lines 123*a*, 123*b*, 123*c* and 123*d*, each one of which is connected to a separate tube passing through multiple pass furnace F-10. An equal flow tube through each line 123*a*, 123*b*, 123*c* and 123*d* is maintained by flow control.

Hydrogen is passed from hydrogen compressor C-10 via line 172 and line 177 where it is preheated on the shell side of heat exchanger E-14 exiting via line 182 where the hydrogen flow is divided under flow control in proportion to the division made of the feedstock into a major hydrogen portion in line 183 and a minor hydrogen portion in line 184. Major hydrogen portion 183 is subdivided in lines 183*a*, 183*b*, 183*c* and 183*d* with approximately equal flow passing through each line, each on flow control.

Hydrogen in line 183*a* is mixed with feedstock in line 123*a* to form a two-phase, liquid-vapor mixture. The mixture is passed through tube 124*a* in multiple pass tube furnace F-10. Line 123*a*, line 183*a* and tube 124*a* are representative of hydrogen in line 183*b*, 183*c* and 183*d* being mixed with feedstock in lines 123*b*, 123*c* and 123*d* and passed through tubes 124*b*, 124*c* and 124*d*.

In multiple pass tube furnace F-10 the temperature of the feedstock-hydrogen mixture is raised to a reactor inlet temperature of about 690° F. The multiple passes through furnace F-10 are recombined in line 125 and passed via line 126 to reactor V-1 containing two fixed beds (V-1A and V-1B) of cobalt-molybdenum hydrogeneration catalyst. Reactor pressure is 700 to 800 psig. Cooling is provided between bed V-1A and V-1B by hydrogen from compressor C-10 through line 173 to line 174 on temperature control cascading to flow control.

Heat of reaction produces a temperature increase of 40° F. across the reactor V-1. Hydrogenated stock leaves reactor V-1 via line 127 at temperature of 730° F. into the tube side of heat exchanger E-13.

The hydrogen minor portion in line 184 is mixed with the minor portion of feedstock in line 122 and flowed via line 185 in a two-phase mixture through the shell side of heat exchanger E-13. The minor portion of feedstock is in an amount to quench the hydrogenerated stock in line 127 from 730° F. to 692° F. under temperature control cascading to flow control.

Feedstock minor portion is heated on the shell side of heat exchanger E-13 to a temperature of approximately 690° F. in line 186. Minor portion in line 186 is combined with major portion in line 125, both at approximately the same temperature and passed together via line 126 to reactor V-1 for hydrogenation.

Hydrogenated stock leaves heat exchanger E-13 tube side via line 128 and is further cooled to approximately 690° F. with quench hydrogen from compressor C-10 via line 173 and line 175 under temperature control cascading to flow control. The stock flows into reactor V-2 where it is passed through two fixed beds V-2A and V-2B of cobalt-molybdenum hydrogeneration catalyst. Interstage hydrogen quench is provided via line 176 under temperature control cascading to flow control. Fully hydrogenerated stock is passed from reactor V-2 via line 131 and cooled on the tube side of heat exchangers E-14, E-12 and E-11. The stock is passed via line 133 to a separator (not shown) where liquid and vapor phases are separated.

DETAILED DESCRIPTION OF THE INVENTION

In a conventional hydrotreater, the charge oil and charge hydrogen are first preheated by heat exchange with hot reactor effluent in feed/effluent and hydrogen effluent heat exchangers and then heated to reactor inlet temperature in the charge oil furnace.

In the invention a minor portion of the entire oil-hydrogen mixture is heated to reactor inlet temperature by heat exchange with the hot reactor effluent. This heat exchange source provides a high level of heat, reduces the duty on the charge heater and reduces hydrogen quench requirements.

Another advantage is that heating a mixture of hydrogen and oil is more efficient than heating them separately. Mixing hydrogen and oil results in a reduction in temperature (but not enthalpy) because some of the oil may vaporize, consuming heat. Some of the hydrogen consumes heat and condenses because of the inverse solubility of hydrogen with temperature. This gives a cooler mixture, increasing the temperature differential in the exchanger. There also tend to be higher heat transfer coefficients when heating a two-phase stream than when heating a single-phase steam. Higher temperature differentials and higher heat transfer coefficients both result in a smaller heat exchanger for the same duty.

This invention is applicable to any distillate, gas oil, residue or other liquid hydrotreater or hydrocracker. It is most useful when the charge consists of cracked products from a coker or cycle oils from a fluid catalytic cracking process. Cracked products have a large heat release and more high level heat available for recovery. Cracked products are also more likely to cause fouling in heat exchangers, increasing the need for adding hydrogen to the oil before the oil is heated.

It is well known in the art that a cracked feedstock should not be heated above 600° F. without a significant amount of hydrogen added to reduce excessive fouling of exchangers. This invention has been used to heat 29% of the oil and 29% of the hydrogen to the 690° F. end-of-run reactor inlet temperature, bypassing the charge heater. Hence the charge heater duty is reduced from 24.63 to 17.55 MMBtu/hr and the recycle compressor flow is reduced from 2.93 to 2.55 MMSCFH saving approximately 125 hp. Cost estimates show that a single three-bed reactor unit and a two two-bed reactor unit with the same amount of catalyst and a heat exchanger between them utilizing this invention would cost the same to build. The multiple reactor configuration has other advantages such as additional operating flexibility due to the extra bed and less time required to change catalyst. Smaller reactors have catalyst changed quicker and both reactors can have their catalyst changed simultaneously.

This invention is shown by way of example.

EXAMPLE 1

A hydrotreater will be constructed and operated as described in FIG. 1. The reactor contains three beds of Criterion HDS-22 cobalt-molybdenum hydrogenation catalyst. The heat and material balance was calculated as follows:

| | Line Number | | | |
|---|---|---|---|---|
| | 201 | 202 | 203 | 204 |
| Temperature, °F. | 240 | 577 | 577 | 577 |
| Pressure, psia | 878 | 858 | 858 | 858 |
| lb/hr. | 194722 | 194722 | 112598 | 82123 |
| | 211 | 212 | 213 | 214 |
| Temperature, °F. | 408 | 665 | 665 | 665 |
| Pressure, psia | 853 | 848 | 848 | 848 |
| lb/hr. | 12166 | 12166 | 7035 | 5131 |
| | 221 | 222 | 223 | 224 |
| Temperature, °F. | 569 | 690 | 569 | 690 |
| Pressure, psia | 822 | 792 | 802 | 792 |
| lb/hr. | 119634 | 119634 | 87254 | 87254 |
| | 225 | 231 | 232 | 233 |
| Temperature, °F. | 690 | 730 | 691 | 666 |
| Pressure, psia | 792 | 740 | 733 | 727 |
| lb/hr. | 206888 | 216992 | 216991 | 216991 |
| | 234 | 241 | 242 | 243 |
| Temperature, °F. | 490 | 197 | 197 | 197 |
| Pressure, psia | 716 | 863 | 863 | 863 |
| lb/hr. | 216992 | 10104 | 5052 | 5052 |

EXAMPLE 2

A hydrotreater will be constructed and operated as described in FIG. 2. Each reactor contains two beds of Criterion HDS-22 cobalt-molybdenum hydrogenation catalyst. The heat and material balance was calculated as follows:

| | Line Number | | | | |
|---|---|---|---|---|---|
| | 119 | 121 | 122 | 123 | 124a |
| Temperature, °C. | 137 | 316 | 316 | 316 | 316 |
| Pressure, kg/cm$^2$ | 68 | 67 | 67 | 67 | 65 |
| kg/hr. | 120586 | 120586 | 42880 | 77706 | 91785 |
| | 125 | 126 | 127 | 128 | 129 |
| Temperature, °C. | 366 | 366 | 388 | 372 | 371 |
| Pressure, kg/cm$^2$ | 62 | 62 | 59 | 58 | 58 |
| kg/hr. | 91786 | 142434 | 145094 | 145094 | 145490 |
| | 131 | 132 | 133 | 172 | 173 |
| Temperature, °C. | 388 | 360 | 260 | 65 | 65 |
| Pressure, kg/cm$^2$ | 56 | 56 | 55 | 67 | 67 |
| kg/hr. | 149922 | 149922 | 149922 | 29333 | 7485 |
| | 174 | 175 | 176 | 177 | 182 |

-continued

| | Line Number | | | | |
|---|---|---|---|---|---|
| Temperature, °C. | 65 | 65 | 65 | 65 | 359 |
| Pressure, kg/cm$^2$ | 67 | 67 | 67 | 67 | 66 |
| kg/hr. | 856 | 127 | 1427 | 7038 | 21849 |
| | 183 | 183a | 184 | 185 | 186 |
| Temperature, °C. | 359 | 359 | 359 | 315 | 366 |
| Pressure, kg/cm$^2$ | 66 | 66 | 66 | 62 | 62 |
| kg/hr. | 14079 | 1942 | 7769 | 50648 | 50649 |

While particular embodiments of the invention have been described, it will be understood, of course, that the invention is not limited thereto since many modifications may be made, and it is, therefore, contemplated to cover by the appended claims any such modifications as fall within the true spirit and scope of the invention.

What is claimed is:

1. A hydrotreating process for catalytically hydrogenating a hydrocarbon stock comprising the steps of:
   - dividing said hydrocarbon stock into two portions comprising a major portion and a minor portion,
   - mixing the major portion with hydrogen to form a major portion mixture at a first temperature, and passing said major portion mixture through a multiple pass tube furnace to yield a heated major portion mixture at a first reactor inlet temperature,
   - passing said heated major portion mixture to a hydrogenation catalyst containing reactor, thereby hydrogenating and heating the major portion mixture by heat of reaction to a reactor outlet temperature,
   - withdrawing a hot hydrogenated stock from said reactor at said reactor outlet temperature wherein said hot hydrogenated stock comprises the entire reactor effluent,
   - mixing the minor portion with hydrogen to form a minor portion mixture at about said first temperature,
   - heating said minor portion mixture by indirect heat exchange with said hot hydrogenated stock to a second reactor inlet temperature approximately equal to said first reactor inlet temperature and then passing said minor portion to said first hydrogenation catalyst containing reactor in the absence of additional heating,
   - said minor portion in an amount sufficient to quench said hot hydrogenated stock to a third temperature approximately equal to said first reactor inlet temperature.

2. The process of claim 1 wherein the minor portion comprises 20 vol % to 40 vol % of the hydrocarbon stock and the major portion comprises the balance.

3. The process of claim 1 wherein the hydrocarbon stock is a cracked hydrocarbon stock.

4. A catalytic hydrotreating process for catalytically hydrogenating a cracked distillate stock comprising the steps of:
   - dividing said cracked distillate stock into two portions comprising a major portion and minor portion,
   - mixing the major portion with hydrogen to form a major portion mixture and passing said major portion mixture through a multiple pass tube furnace to yield a heated major portion at a reaction zone inlet temperature of 600° to 700° F.,
   - passing the heated major portion mixture through a hydrogenation catalyst zone thereby forming a hydrogenated mixture at a reaction zone outlet temperature of 630° to 750° F., mixing the minor portion with hydrogen to form a minor portion mixture, and heating said minor portion mixture by indirect heat exchange with the entire hydrogenated mixture to about said reaction zone inlet temperature and then passing said minor portion to said hydrogenation catalyst zone in the absence of additional heating, said minor portion in an amount to quench said hot hydrogenated stock from said reaction zone outlet temperature to said reaction zone inlet temperature.

* * * * *